US006205598B1

(12) United States Patent
Black et al.

(10) Patent No.: US 6,205,598 B1
(45) Date of Patent: Mar. 27, 2001

(54) PROTECTIVE COVER WATER FIXTURES

(76) Inventors: Ruth Ann Black; Theron Tobias, both of 2857 Webberville Rd., Webberville, MI (US) 48892

( * ) Notice: Subject to any disclaimer, the term of this patent is extended or adjusted under 35 U.S.C. 154(b) by 0 days.

(21) Appl. No.: 09/544,435

(22) Filed: Apr. 7, 2000

(51) Int. Cl.[7] ..... A47K 3/02
(52) U.S. Cl. ..... 4/580; 4/DIG. 18
(58) Field of Search ..... 4/580, 661, DIG. 18

(56) References Cited

U.S. PATENT DOCUMENTS 3,199,121 * 8/1965 Greto ..... 4/DIG. 18
3,940,196 * 2/1976 Ketchel ..... 4/661 X

* cited by examiner

*Primary Examiner*—Henry J. Recla

(57) ABSTRACT

A protective cover for water fixtures for covering knobs and spout of bathtub and shower water fixtures. The protective cover for water fixtures includes a valve cover portion. The valve cover portion has a front wall, a top wall, a bottom wall, a first side wall and a second side wall. The valve cover portion has an interior space. The top wall and the bottom wall each have a plurality of slots therein. A plurality of fastening means removably fastens the valve cover portion over the hot and cold water fixtures. Each of the fastening means generally is U-shaped and has a first leg, a second leg and a base member. Each of the first legs is coupled to a wall such that the second legs extend upwardly away from the base members. The fastening means is spaced such that the second legs may be removably inserted in the slots in the top and bottom walls of the valve cover portion.

7 Claims, 3 Drawing Sheets

FIG 3
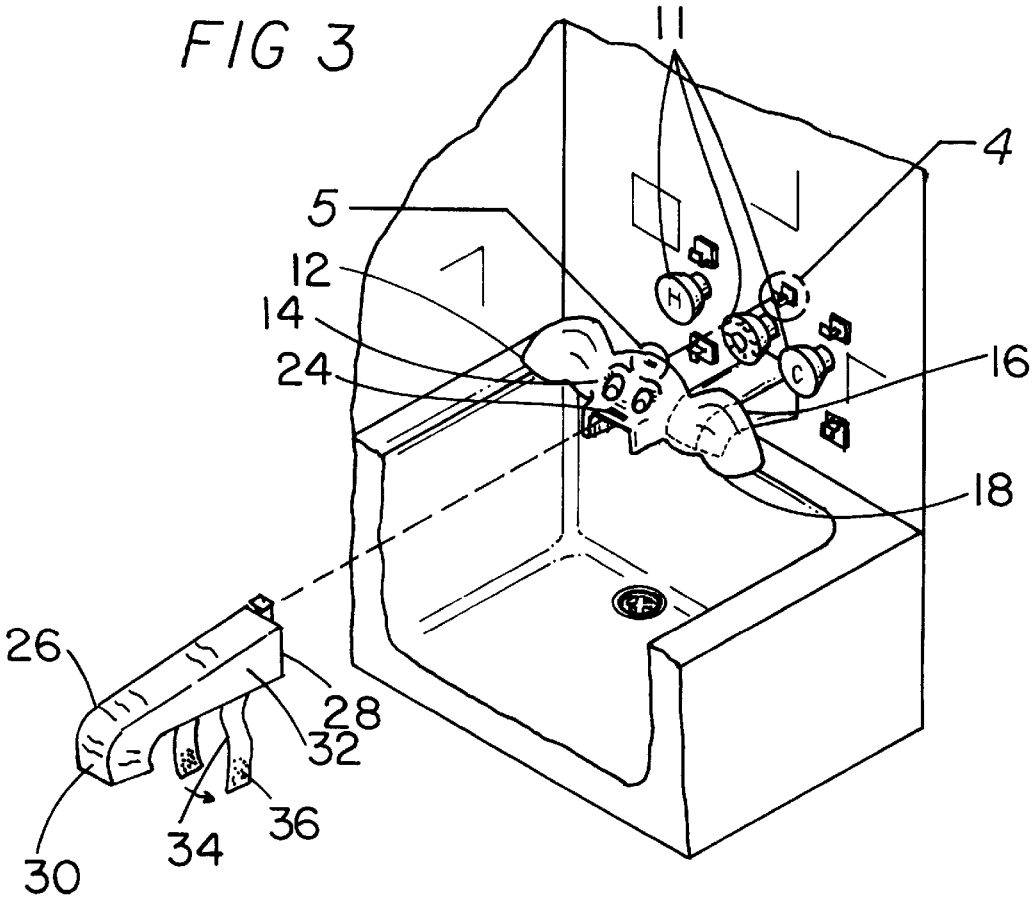
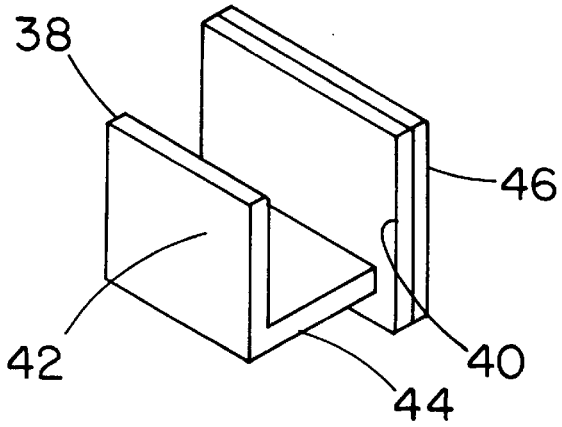
FIG 4
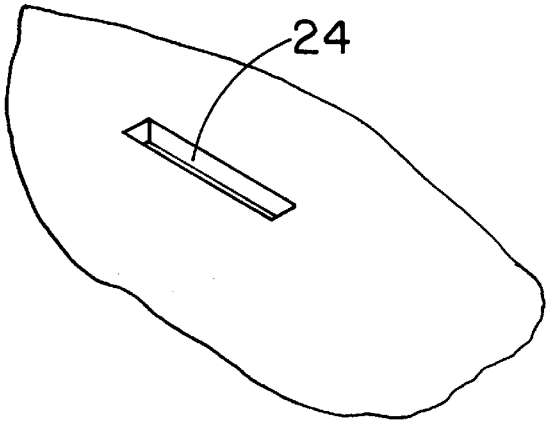
FIG 5

PROTECTIVE COVER WATER FIXTURES

BACKGROUND OF THE INVENTION

1. Field of the Invention

The present invention relates to faucet knob covers and more particularly pertains to a new protective cover for water fixtures for covering knobs and spout of bathtub and shower water fixtures.

2. Description of the Prior Art

The use of faucet knob covers is known in the prior art. More specifically, faucet knob covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,125,577; U.S. Pat. No. 4,353,139; U.S. Pat. No. 3,940,196; U.S. Des. Pat. No. 282,563; U.S. Pat. No. 5,590,682; and U.S. Des. Pat. No. 298,161.

While these devices fulfill their respective, particular objectives and requirements, the aforementioned patents do not disclose a new protective cover for water fixtures. The inventive device includes a valve cover portion. The valve cover portion has a front wall, a top wall, a bottom wall, a first side wall and a second side wall. The valve cover portion has an interior space. The top wall and the bottom wall each have a plurality of slots therein. A plurality of fastening means removably fastens the valve cover portion over the hot and cold water fixtures. Each of the fastening means generally is U-shaped and has a first leg, a second leg and a base member. Each of the first legs is coupled to a wall such that the second legs extend upwardly away from the base members. The fastening means is spaced such that the second legs may be removably inserted in the slots in the top and bottom walls of the valve cover portion.

In these respects, the protective cover for water fixtures according to the present invention substantially departs from the conventional concepts and designs of the prior art, and in so doing provides an apparatus primarily developed for the purpose of covering knobs and spout of bathtub and shower water fixtures.

SUMMARY OF THE INVENTION

In view of the foregoing disadvantages inherent in the known types of faucet knob covers now present in the prior art, the present invention provides a new protective cover for water fixtures construction wherein the same can be utilized for covering knobs and spout of bathtub and shower water fixtures.

The general purpose of the present invention, which will be described subsequently in greater detail, is to provide a new protective cover for water fixtures apparatus and method which has many of the advantages of the faucet knob covers mentioned heretofore and many novel features that result in a new protective cover for water fixtures which is not anticipated, rendered obvious, suggested, or even implied by any of the prior art faucet knob covers, either alone or in any combination thereof.

To attain this, the present invention generally comprises a valve cover portion. The valve cover portion has a front wall, a top wall, a bottom wall, a first side wall and a second side wall. The valve cover portion has an interior space. The top wall and the bottom wall each have a plurality of slots therein. A plurality of fastening means removably fastens the valve cover portion over the hot and cold water fixtures. Each of the fastening means generally is U-shaped and has a first leg, a second leg and a base member. Each of the first legs is coupled to a wall such that the second legs extend upwardly away from the base members. The fastening means is spaced such that the second legs may be removably inserted in the slots in the top and bottom walls of the valve cover portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective cover for water fixtures apparatus and method which has many of the advantages of the faucet knob covers mentioned heretofore and many novel features that result in a new protective cover for water fixtures which is not anticipated, rendered obvious, suggested, or even implied by any of the prior art faucet knob covers, either alone or in any combination thereof.

It is another object of the present invention to provide a new protective cover for water fixtures which may be easily and efficiently manufactured and marketed.

It is a further object of the present invention to provide a new protective cover for water fixtures which is of a durable and reliable construction.

An even further object of the present invention is to provide a new protective cover for water fixtures which is susceptible of a low cost of manufacture with regard to both materials and labor, and which accordingly is then susceptible of low prices of sale to the consuming public, thereby making such protective cover for water fixtures economically available to the buying public.

Still yet another object of the present invention is to provide a new protective cover for water fixtures which provides in the apparatuses and methods of the prior art some of the advantages thereof, while simultaneously overcoming some of the disadvantages normally associated therewith.

Still another object of the present invention is to provide a new protective cover for water fixtures for covering knobs and spout of bathtub and shower water fixtures.

Yet another object of the present invention is to provide a new protective cover for water fixtures which includes a valve cover portion. The valve cover portion has a front wall, a top wall, a bottom wall, a first side wall and a second side wall. The valve cover portion has an interior space. The top wall and the bottom wall each have a plurality of slots therein. A plurality of fastening means removably fastens the valve cover portion over the hot and cold water fixtures. Each of the fastening means generally is U-shaped and has a first leg, a second leg and a base member. Each of the first legs is coupled to a wall such that the second legs extend upwardly away from the base members. The fastening means is spaced such that the second legs may be removably inserted in the slots in the top and bottom walls of the valve cover portion.

Still yet another object of the present invention is to provide a new protective cover for water fixtures that will cover all of the water fixtures using one device.

Even still another object of the present invention is to provide a new protective cover for water fixtures that may resemble animals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the present invention.

FIG. 4 is a schematic perspective view of the fastening means of the present invention.

FIG. 5 is a schematic perspective view of a slot of the present invention.

DESCRIPTION OF THE PREFERRED EMBODIMENT

Figure 1:
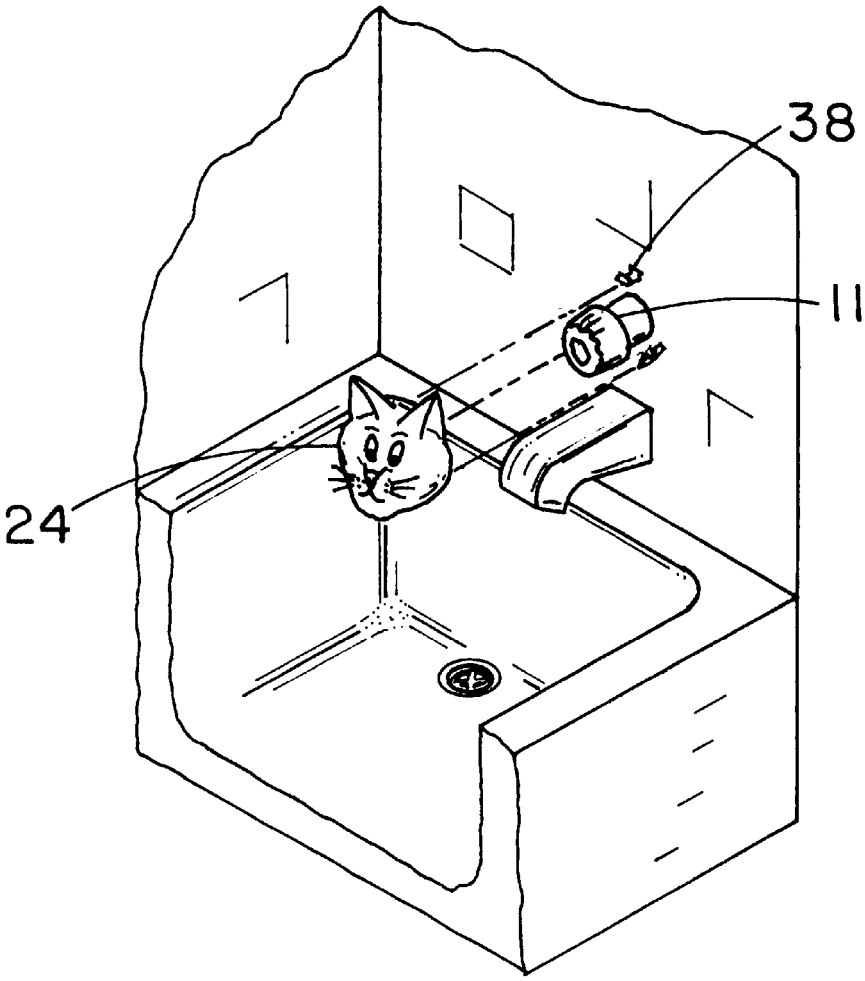
FIG. 1 is a schematic perspective view of a new protective cover for water fixtures according to the present invention.
Figure 2:
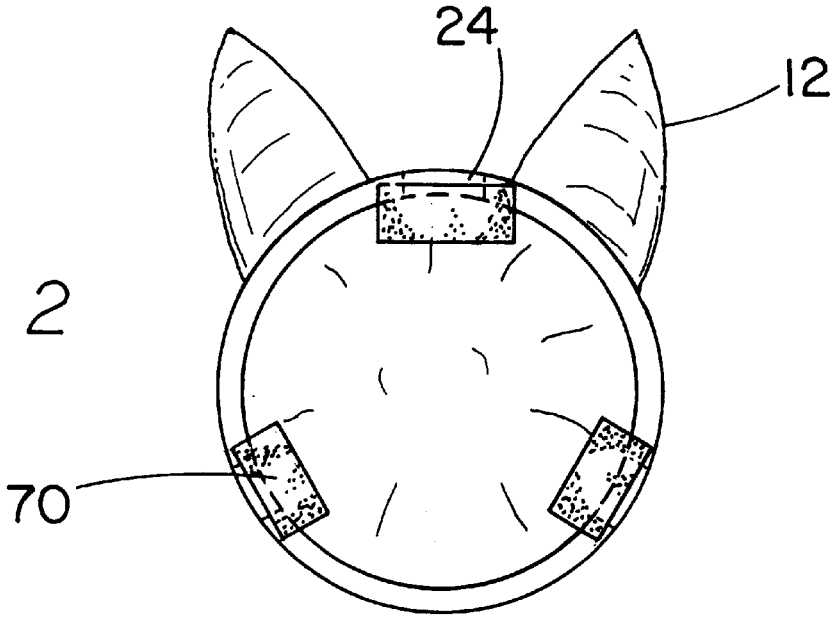
FIG. 2 is a schematic back view of the present invention.
Figure 6:
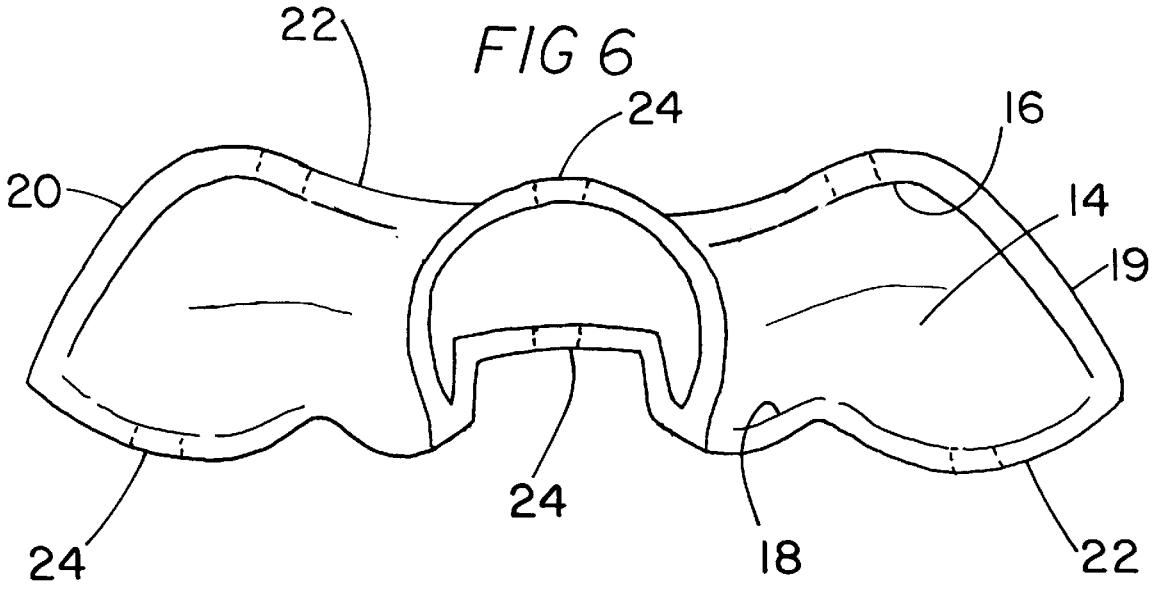
FIG. 6 is a schematic back view of the present invention.

With reference now to the drawings, and in particular to FIGS. 1 through 7 thereof, a new protective cover for water fixtures embodying the principles and concepts of the present invention and generally designated by the reference numeral 10 will be described.

As best illustrated in FIGS. 1 through 7, the protective cover 10 for water fixtures 11 generally comprises a valve cover portion 12. The valve cover portion 12 has a front wall 14, a top wall 16, a bottom wall 18, a first side wall 19 and a second side wall 20. The valve cover portion has an interior space. The top wall 16 and the bottom wall 18 each has free edge 22. The valve cover portion 12 has a plurality of slots 24 therein. Three of the slots 24 are in the top wall 16. The slots 24 in the top wall 16 are spaced from each other. Each of the slots 24 in the top wall 16 is located generally adjacent to the free edge 22 of the top wall 16. Two of the slots 24 are in the bottom wall 18. Each of the slots 24 in the bottom wall 18 is located generally adjacent to the free edge 22 of the bottom wall 18. One of the slots 24 is in the front wall 14. The slot 24 in the front wall 14 is located in a central portion of the front wall 14. Ideally, the valve cover portion 12 has an interior space having an area substantially equal to twelve inches long by four inches high by four inches wide. Preferably, as in FIG. 3, the front wall 14 is shaped to resemble the head of an animal. The valve cover portion 12 covers the hot and cold water fixtures 11.

A spout cover portion 26 is elongate and has a first end 28 and a second end 30. The spout cover portion 26 is adapted to cover the spout of a bath tub. The spout cover portion 26 is generally hollow and has an open bottom side and an open first end 28. The first end 28 has a peripheral edge having a bracket 30 thereon. The bracket 30 is adapted to removably couple to the slot 24 in the front wall 14 of the valve cover portion 12. The spout cover portion 26 has a pair of opposite sides 32. Each of the sides 32 has a strap 34 fixedly coupled thereto. Each of the straps 34 has an end 36 having a securing means thereon for removably securing the straps 34 together. Each of the securing means is a hook and loop securing means. The straps may be fastened about the spout of the bathtub.

A plurality of fastening means 38 removably fastens the valve cover portion 12 over the hot and cold water fixtures 11. Each of the fastening means 38 is generally is U-shaped. Each of the fastening means has a first leg 40, a second leg 42 and a base member 44. Each of the first legs 40 has an exterior surface having an adhesive thereon 46. The first legs 40 are coupled to a wall such that the second legs 42 extend upwardly away from the base members 44. The fastening means 38 are spaced such that the second legs 42 may be removably inserted in the slots 24 in the top 16 and bottom 18 walls of the valve cover portion 12.

Figure 7:
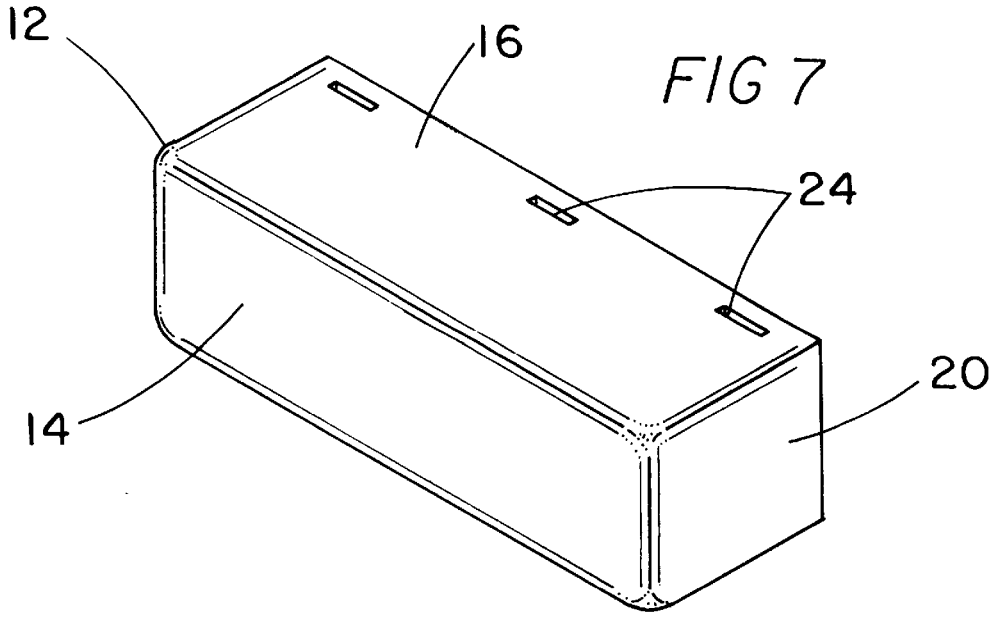
FIG. 7 is a schematic perspective view of the present invention.

FIG. 1 depicts a smaller version of the valve cover 12. This embodiment only uses three slots 24 and the front wall resembles a cat. This version is for use on bathroom water fixtures which combine the hot and cold water fixtures 11 into one fixture. This version also utilizes adhesive 70 which may be used instead of the fastening means 38. FIG. 3 depicts an elephant having a front wall forming a face and ears. The spout cover 26 may be shaped into a trunk for the elephant. FIG. 7 shows the basis structure of the device. Although a cat and an elephant are shown, the device 12 could come in virtually any shape, including shells, bears and dogs. Ideally, the device is made from an elastomeric material, plastic or a molded foamed material.

In use, the fastening means 38 are placed about the fixtures 11 on the wall of the bathtub/shower. The device 10 is then placed on the fastening means 38 by placing the second legs 42 through the slots 24 found in the valve cover portion 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A protective cover device for water fixtures, said device comprising:

a valve cover portion, said valve cover portion having a front wall, a top wall, a bottom wall, a first side wall and a second side wall, said valve cover portion having an interior space, said top wall and said bottom wall each having a plurality of slots therein;

a plurality of fastening means for removably fastening said valve cover portion over said hot and cold water fixtures, each of said fastening means generally being U-shaped, each of said fastening means having a first leg, a second leg and a base member, each of said first legs being coupled to a wall such that said second legs extend upwardly away from said base members, said fastening means being spaced such that said second legs may be removably inserted in said slots in said top and bottom walls of said valve cover portion.

2. The protective cover device for water fixtures as in claim 1, wherein said valve cover portion comprises:

said top wall and said bottom wall each having free edge, three of said slots being in said top wall, said slots in said top wall being spaced, each of said slots being located generally adjacent to said free edge of said top wall, two of said slots being in said bottom wall, each of said slots in said bottom wall being located generally adjacent to said free edge of said bottom wall.

3. The protective cover device for water fixtures as in claim 2, said valve cover portion having an interior space, said interior space having an area substantially equal to twelve inches long by four inches high by four inches wide.

4. The protective cover device for water fixtures as in claim 3, further including said front wall being shaped to resemble the head of an animal.

5. The protective cover device for water fixtures as in claim 1, further comprising:

one of said slots being in said front wall, said slot in said front wall being located in a central portion of said front wall; and a spout cover portion, said spout cover portion being elongate, said spout cover portion having a first end and a second end, said spout cover portion being generally hollow and having an open bottom side and an open first end, said first end having a peripheral edge having bracket thereon, said bracket being adapted to removably couple to said slot in said front wall of said valve cover portion.

6. The protective cover device for water fixtures as in claim 5, wherein said spout cover portion comprises:

said spout cover portion having a pair of opposite sides, each of said sides having a strap fixedly coupled thereto, each of said straps having an end having securing means thereon for removably securing said straps together, each of said securing means being a hook and loop securing means.

7. A protective cover device for water fixtures, said device comprising:

a valve cover portion, said valve cover portion having a front wall, a top wall, a bottom wall, a first side wall and a second side wall, said valve cover portion having an interior space, said top wall and said bottom wall each having free edge, said valve cover portion having a plurality of slots therein, three of said slots being in said top wall, said slots in said top wall being spaced, each of said slots being located generally adjacent to said free edge of said top wall, two of said slots being in said bottom wall, each of said slots in said bottom wall being located generally adjacent to said free edge of said bottom wall, one of said slots being in said front wall, said slot in said front wall being located in a central portion of said front wall, said valve cover portion having an interior space, said interior space having an area substantially equal to twelve inches long by four inches high by four inches wide, said front wall being shaped to resemble the head of an animal, wherein said valve cover portion covers the hot and cold water fixtures;

a spout cover portion, said spout cover portion being elongate, said spout cover portion having a first end and a second end, said spout cover portion being generally hollow and having an open bottom side and an open first end, said first end having a peripheral edge having bracket thereon, said bracket being adapted to removably couple to said slot in said front wall of said valve cover portion, said spout cover portion having a pair of opposite sides, each of said sides having a strap fixedly coupled thereto, each of said straps having an end having securing means thereon for removably securing said straps together, each of said securing means being a hook and loop securing means; and a plurality of fastening means for removably fastening said valve cover portion over said hot and cold water fixtures, each of said fastening means generally being U-shaped, each of said fastening means having a first leg, a second leg and a base member, each of said first legs having an exterior surface having an adhesive thereon, each of said first legs being coupled to a wall such that said second legs extend upwardly away from said base members, said fastening means being spaced such that said second legs may be removably inserted in said slots in said top and bottom walls of said valve cover portion.

* * * * *